United States Patent [19]

Ruesch

[11] Patent Number: 4,851,981

[45] Date of Patent: Jul. 25, 1989

[54] EXTENSION DEVICE FOR A LAMP HARP ASSEMBLY

[75] Inventor: Clarence W. Ruesch, Palos Hills, Ill.

[73] Assignee: Reliable Metal Stamping Co., Inc., Franklin Park, Ill.

[21] Appl. No.: 248,786

[22] Filed: Sep. 23, 1988

[51] Int. Cl.[4] ..... F21V 17/00

[52] U.S. Cl. ..... 362/452; 362/417

[58] Field of Search ..... 362/417, 433, 449, 452

[56] References Cited

U.S. PATENT DOCUMENTS

| | | | |
|---|---|---|---|
| 1,537,789 | 5/1925 | Yentis et al. | 362/452 |
| 1,946,959 | 3/1934 | Auerbach | 362/452 |
| 2,408,522 | 10/1946 | Leef | 362/452 |
| 4,096,556 | 6/1978 | Berger et al. | 362/417 |
| 4,229,784 | 10/1980 | Noguchi | 362/414 |

OTHER PUBLICATIONS

Photographs A–F of a Harp Extender Device, (no date given).

*Primary Examiner*—Stephen F. Husar

*Attorney, Agent, or Firm*—Dressler, Goldsmith, Shore, Sutker & Milnamow

[57] ABSTRACT

An extension device is provided for use in a lamp harp assembly of the type that includes a lamp-mounted base bracket having a pair of arms that each include an approximately U-shaped cross-section wall defining a channel having a generally vertically oriented slot and a top end opening for removably receiving the bottom end of a leg of a bail to which can be mounted a shade. The device includes a pair of rigid members which each have an upper portion having a top end opening for receiving the bottom end of the bail leg. Each member further includes a lower portion extending from the upper portion and having a laterally extending peripheral retaining ring for defining an aperture into which can be inserted the base bracket arm wall. The lower portion also has a generally vertically oriented, inwardly offset retaining tab for being inserted into the open top end of the bracket arm wall to engage the wall.

10 Claims, 2 Drawing Sheets

EXTENSION DEVICE FOR A LAMP HARP ASSEMBLY

TECHNICAL FIELD

This invention relates to an apparatus for use with conventional types of lamp harp assemblies which include a lamp-mounted base bracket to which is removably attached a bail for holding the lamp shade. In particular, the apparatus permits the lamp harp assembly to be extended to accommodate larger size light bulbs.

BACKGROUND OF THE INVENTION AND TECHNICAL PROBLEMS POSED BY THE PRIOR ART

Many conventional lamps and other lighting fixtures in use today include a base bracket having a pair of oppositely extending arms into which are removably mounted legs of a bail. The bail extends up opposite sides of the light bulb and has a suitable structure at the top to which a shade can be mounted.

It is not uncommon for there to be a need to replace an incandescent bulb with a larger incandescent bulb or to replace an incandescent bulb with a fluorescent bulb having a base configuration quite different from the incandescent bulb. In many cases, the original bail provided with the lamp is not large enough, in width and/or height, to accommodate the new bulb.

It would be desirable to provide an inexpensive apparatus for use with the existing bail in a manner that would accommodate the larger bulb. Further, it would be advantageous if such apparatus could be inexpensively manufactured and easily installed. To this end, it would be desirable to provide such an apparatus with means for connecting it to the bail and to the lamp base bracket in a manner that would not require the use of tools and screws or other fasteners. Further, it would be beneficial if the resulting connected assembly was secure and stable.

SUMMARY OF THE INVENTION

An extension device is provided for use in a lamp harp assembly of the type that includes a lamp-mounted base bracket having a pair of arms that each include an approximately U-shaped cross-section wall defining a channel having a generally vertically oriented slot and a top end opening for removably receiving the bottom end of a leg of a bail to which can be mounted a shade.

The extension device includes a pair of rigid members which each have an upper portion that has a top end opening for receiving the bottom end of the bail leg.

Each rigid member also has a lower portion extending from the upper portion. The lower portion includes a laterally extending peripheral retaining ring means for defining an aperture into which can be inserted the base bracket arm wall. The lower portion also has a generally vertically oriented, inwardly offset retaining tab for being inserted into the open top end of the bracket arm wall to engage the wall.

Screws or other fasteners are not required to install the extension device rigid members, and the extension device rigid members can be easily removed, if desired, without the use of tools.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the extension device apparatus of this invention is described in the normal (upright) operating position, and terms such as upper, lower, horizontal, etc., are used with reference to this position. It will be understood, however, that the apparatus of this invention may be manufactured, stored, transported, and sold in an orientation other than the position described.

The apparatus of this invention is used with certain conventional components the details of which, although not fully illustrated or described, will be apparent to those having skill in the art and an understanding of the necessary functions of such components.

Figure 1:
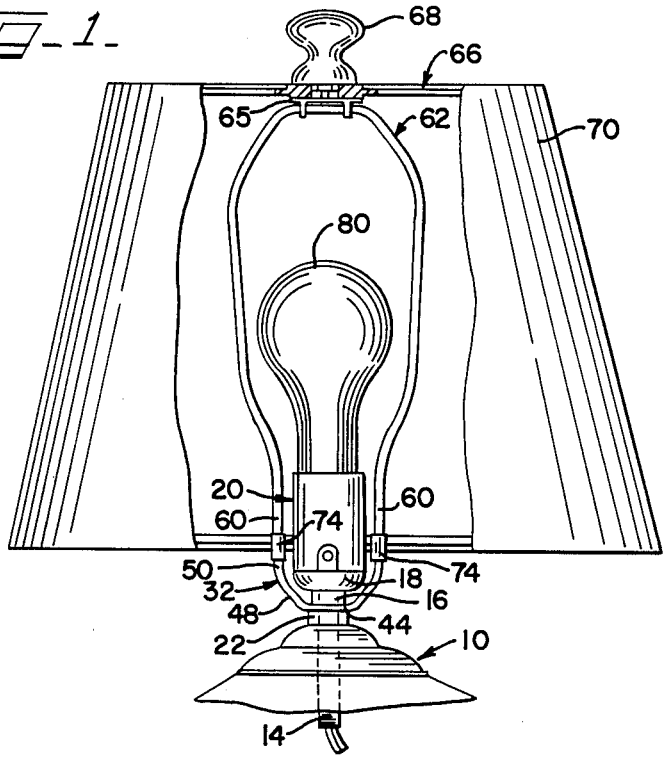
FIG. 1. PRIOR ART
FIG. 1 is a fragmentary, elevational view of a prior art lamp and harp assembly with portions broken away to better illustrate interior detail.

A conventional lamp and harp assembly is illustrated in FIG. 1. The lamp includes a base 10 having an aperture (not visible) to receive a nipple or hollow member 14 whose upper end is threaded and screwed into a tapped collar 16 in the base part 18 of a lamp socket 20. The lamp base has a hexagonal shoulder having an internally threaded bore for threadingly mounting the member 14 to the lamp base 10.

Figure 3:
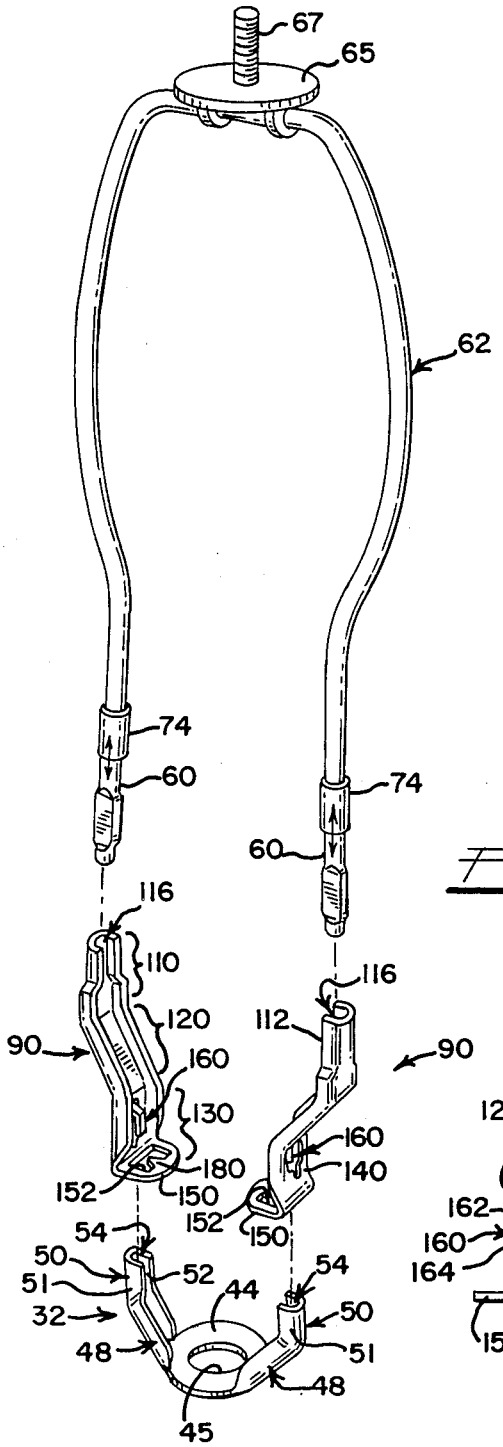
FIG. 3 is an exploded, perspective view of the lamp harp assembly with the extension device of the present invention.

A lamp harp base bracket 32 is mounted between the shoulder 22 and the collar 16. As best illustrated in FIG. 3, the bracket 32 comprises a central, flat, bearing portion 44 having an aperture 45 for accommodating the nipple or hollow member 14. The bearing portion 44 is adapted to be clamped against the collar 16 by the shoulder 22.

To assemble the components, the bracket 32 is slipped over the member 14 before the socket 20 is screwed onto the member 14 so that the bearing portion 44 is clamped between the socket collar 16 and the shoulder 22.

The bracket 32 includes a pair of oppositely extending arms which each have a laterally extending and upwardly angled first portion 48 and a generally vertically extending second portion 50.

Figure 6:
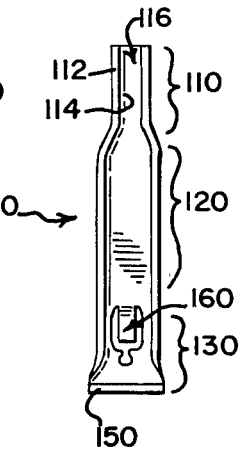
FIG. 6 is a front view of the extension device rigid member.

As best illustrated in FIGS. 3 and 6, each vertically extending second portion 50 of each base bracket arm comprises a wall 51 having an approximately U-shaped cross-section (FIG. 3). The wall 52 defines a channel having a generally vertically oriented slot 52 and a top end opening 54.

Figure 2:
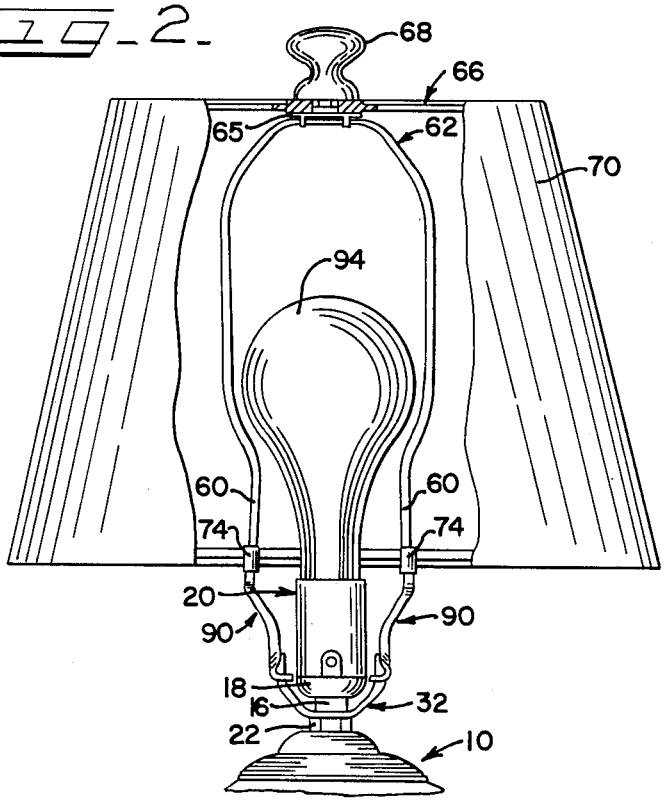
FIG. 2 is a view similar to FIG. 1, but showing the extension device of the present invention installed to accommodate a larger bulb.

The top end opening 54 removably receives the bottom end of one of two legs 60 of a conventional bail 62 as shown in FIG. 1. The bail 62 carries a conventional, top support plate 65 and a threaded shank 67 (FIG. 3) on which can be mounted a shade-holding element or spider frame 66. The shade-holding frame 66 may be of any suitable construction which can be mounted over the shank 67 on the plate 65 and be engaged by a finial 68 or the like as shown in FIG. 2. A suitable conventional shade 70 (FIGS. 1 and 2) is supported from the shade-holding element 66.

The bottom end of each leg 60 of the bail 62 is received in the channel defined by the wall 51 of the vertically extending second portion 50 of the base bracket arm. Typically, the lamp harp assembly also includes a conventional sleeve 74 on each bail leg 60 which is slidable down and over the exterior of the vertically extending second portion 50 of the base bracket arm so as to surround the arm slot 52 and open end 54 to retain the leg 60 within the arm slot 52.

As best illustrated in FIG. 1, the conventional bail 62 furnished with the lamp accommodates a light bulb 80 which is screwed into the socket 20. Smaller bulbs can, of course, be accommodated also. However, if it is desired to use a larger bulb, or perhaps a fluorescent bulb with a larger diameter base configuration, then the lamp harp assembly bail 62 may not be large enough. To this end, the present invention provides a unique solution.

In particular, as best illustrated in FIG. 2, the bail 62 can be extended, in both height and width, by means of an extension device which comprises a pair of rigid members 90, and the resulting configuration can accommodate a larger size bulb 94.

As best illustrated in FIGS. 3–6, each rigid member 90 has an upper portion 110 having an approximately U-shaped cross-section wall 112 defining a channel having a generally vertically oriented slot 114 and a top end opening 116 for receiving the bottom end of the bail leg 60.

Each rigid member 90 also preferably includes an intermediate extension portion 120 which extends at an oblique angle inwardly relative to the upper portion 110.

Figure 4:
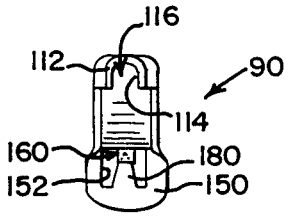
FIG. 4 is a top plan view of one of the extension device rigid members.
Figure 5:
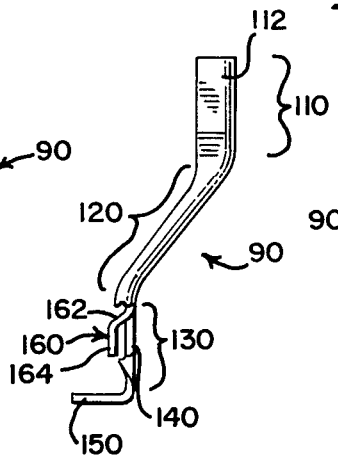
FIG. 5 is a side view of the extension device rigid member.

Further, each rigid member 90 also includes a lower portion 130 connected to, and extending from, the upper portion 110 via the intermediate portion 120. The lower portion 130 includes a generally vertically oriented rear wall 140 (FIGS. 3 and 5) and a laterally extending peripheral retaining ring means or ring 150 which defines an aperture 152 (FIGS. 3 and 4).

The lower portion 130 also has a generally vertically oriented retaining tab 160 (FIGS. 5 and 6) which is inwardly offset from the rear wall 140. The tab 160 includes an angled first portion 162 (FIG. 5) which is connected to the rear wall 140 and includes a cantilevered portion 164 (FIG. 5) extending from the first portion 162 generally parallel to, but spaced from, the rear wall 140.

The lower portion 130 also includes a protuberance 180 (FIGS. 3 and 4) extending from the retaining ring means 150 into the aperture 152. In the preferred embodiment illustrated, the protuberance 180 has a configuration of an isosceles triangle.

The rigid members 90 of the extension device of the present invention can be readily installed in a conventional lamp harp assembly First, with reference to the conventional lamp illustrated in FIG. 1, the bail 62 is removed from the base bracket 32. Then, one member 90 is inserted over the upstanding portion 50 of one of the base bracket arms, and the other member 90 is inserted over the upstanding portion 50 of the other of the base bracket arms. In particular, relative movement is effected between the member 90 and the upstanding portion 50 of the base bracket arm so that the upstanding portion 50 becomes inserted into, and received in, the aperture 152 defined by the retaining ring means 150.

The vertex angle portion of the triangular protuberance 180 enters into the channel of the bracket arm upper portion 50, and the congruent sides of the triangular protuberance 180 engage the wall 51 of the channel defined in the base bracket arm portion 50. Relative axial movement between the member 90 and the base bracket 32 is effected until the offset tab 160 is received in the open top end 54 of the base bracket arm portion 50 so that the tab 160 engages the top edge of the wall 51 of the base bracket portion 50. Most of the vertical load of the bail 62 and lamp shade is thus transferred through the tab 160 of each member 90 to the base bracket 32.

The engagement of the peripheral retaining ring means 150 with the base bracket arm portion 50 maintains the rigid member 90 in its generally vertical orientation. The engagement of the protuberance 180 with the wall 51 on the inside of the slot 52 in the base bracket arm portion 50 prevents the member 90 from rotating or twisting about a vertical axis on the base bracket arm portion 50.

After each rigid member 90 is properly installed on the associated base bracket arm portion 50, the bottom end of a leg 60 of the bail 62 is then inserted in a respective one of the rigid members 90. In particular, the bottom end of a leg 60 is inserted into the open top end 116 of the upper portion 110 of the member 90. During this process, the sleeve 74 is lifted upwardly and, after the bottom end of the leg 60 is fully inserted into the upper portion 110 of the member 90, the sleeve 74 is then slid back down and over the outside of the upper portion 110 to retain the bail leg 60 within the member 90.

When both rigid members 90 of the extension device of the resent invention have been properly installed as described above and as illustrated in FIG. 2, it is seen that the bail 62 is maintained at a position relative to the lamp socket 20 that is elevated above the original position This accommodates a taller bulb 94.

Further, in the preferred form of the rigid member 90 illustrated, the rigid member 90 angles outwardly from the base bracket 32. The bail legs 60 are spread apart as necessary to fit into the tops of the members 90. This provides a greater width between the legs 60 of the bail 62 so as to accommodate a wider bulb or to accommodate a wider portion of a fluorescent bulb base element (not illustrated).

Additionally, it will be appreciated that the rigid members 90 of the extension device of the present invention can be installed without requiring the use of separate screws or other fasteners and without requiring the use of tools. Further, if it is desired to return the lamp harp assembly to the original configuration, the rigid members 90 of the extension device can be easily removed without tools.

It will be readily observed from the foregoing detailed description of the invention and from the illustrated embodiment thereof that numerous variations and modifications may be effected without departing from the true spirit and scope of the novel concepts or principles of this invention.

What is claimed is:

1. An extension device for use in a harp assembly of the type that includes a lamp-mounted base bracket having a pair of arms that each include an approximately U-shaped cross-section wall defining a channel having a generally vertically oriented slot and a top end opening for removably receiving the bottom end of a leg of a bail to which can be mounted a shade, said extension device comprising:

a pair of rigid members each having an upper portion having a top end opening for receiving the bottom end of said bail leg; and a lower portion extending from said upper portion and having a laterally extending peripheral retaining ring means for defining an aperture into which can be inserted said base bracket arm wall, said lower portion also having a generally vertically oriented, inwardly offset retaining tab for being inserted into the open top end of said bracket arm wall to engage said wall.

2. The extension device in accordance with claim 1 in which each said rigid member includes an intermediate extension portion between, and connecting, said upper portion and said lower portion.

3. The extension device in accordance with claim 2 in which said intermediate portion extends at an oblique angle relative to said upper portion.

4. The extension device in accordance with claim 1 in which said lower portion includes a protuberance extending from said retaining ring means into said aperture for projecting laterally into said bracket arm wall channel slot to engage said wall and prevent rotation of said rigid member relative to said bracket.

5. The extension device in accordance with claim 4 in which said protuberance has the configuration of an isosceles triangle in top plan view with the vertex angle adapted for entering into said bracket arm wall channel slot so that the congruent sides of said triangular protuberance engage said wall.

6. The extension device in accordance with claim 1 in which said lower portion includes a generally vertically oriented rear wall from which said tab extends.

7. The extension device in accordance with claim 6 in which said tab includes an angled first portion connected to said rear wall and a cantilevered portion extending from said first portion generally parallel to, but spaced from, said rear wall.

8. The extension device in accordance with claim 1 in which said upper portion includes an approximately U-shaped cross-section wall defining a channel having a generally vertically oriented slot communicating with said top end opening.

9. An extension device for use in a harp assembly of the type that includes a lamp-mounted base bracket having a pair of arms that each include a generally vertically extending receiving portion having an approximately U-shaped cross-section wall defining a channel having a generally vertically oriented slot and a top end opening at the upper distal end of said receiving portion for receiving the bottom end of a leg of a bail to which can be mounted a shade, said extension device comprising:

a pair of rigid members each having an upper portion having an approximately U-shaped cross-section wall defining a channel having a generally vertically oriented slot and a top end opening for receiving the bottom end of said bail leg;

an intermediate extension portion depending from said upper portion at an oblique angle; and a lower portion extending from said intermediate extension portion, said lower portion have a peripheral retaining ring defining an aperture into which can be inserted said base bracket arm receiving portion, said lower portion also having a generally vertically oriented, inwardly offset retaining tab for being inserted into the open end of said bracket arm receiving portion to engage said U-shaped cross-section wall of said bracket arm receiving portion.

10. The extension device in accordance with claim 9 in which said lower portion includes a protuberance extending from said retaining ring into said aperture for projecting laterally into said bracket arm wall channel slot to engage said wall and prevent rotation of said rigid member relative to said bracket.

* * * * *